US005492276A

United States Patent [19]

Kaylor

[11] Patent Number: 5,492,276

[45] Date of Patent: Feb. 20, 1996

[54] METHOD AND MEANS FOR MERGING LIQUID STREAMS

[75] Inventor: Joseph B. Kaylor, Manassas, Va.

[73] Assignee: Valkyrie Scientific Propritary, L.C., Reston, Va.

[21] Appl. No.: 229,661

[22] Filed: Apr. 19, 1994

[51] Int. Cl.[6] ..... B05B 7/00

[52] U.S. Cl. ..... 239/428; 239/433

[58] Field of Search ..... 239/418, 422, 239/428, 433, 587.2, 543, 279; 169/14, 52

[56] References Cited

U.S. PATENT DOCUMENTS

| | | | |
|---|---|---|---|
| 134,110 | 12/1872 | Tapley | 239/428 |
| 139,550 | 6/1873 | Cronin | 239/433 X |
| 255,430 | 3/1882 | Holland, Jr. | 239/587.2 X |
| 608,192 | 8/1898 | Glazier | 239/587.2 |
| 865,146 | 9/1907 | Albee | 239/587.2 |
| 1,282,905 | 10/1918 | Meigs | 169/14 |
| 1,880,826 | 10/1932 | Corley | 239/587.2 X |
| 1,961,198 | 6/1934 | Corley | 239/587.2 X |
| 4,674,686 | 6/1987 | Trapp | 239/279 |

FOREIGN PATENT DOCUMENTS

| | | | |
|---|---|---|---|
| 873045 | 4/1953 | Germany | 239/587.2 |

*Primary Examiner*—Andres Kashnikow
*Assistant Examiner*—Lesley D. Morris
*Attorney, Agent, or Firm*—Roland H. Shubert

[57] ABSTRACT

A plurality of relatively high pressure, but low velocity, liquid entry streams, that may be of different pressures and flow rates, are directly combined to form a single exit stream of higher velocity but lower pressure by merging the streams in a waterway having an elongated, generally ovoid shape. The entering streams are arranged in an equi-spaced relationship about the longitudinal axis of the waterway, and the cross-section of each entering stream is configured as an ellipse that is oriented with the major ellipse axis generally parallel to the waterway longitudinal axis, but offset therefrom by a small angle. The entering streams mesh and rotate within the waterway to form a unified exit stream.

18 Claims, 5 Drawing Sheets

METHOD AND MEANS FOR MERGING LIQUID STREAMS

TECHNICAL FIELD

This invention relates generally to methods and devices for merging two or more flowing streams of liquid to obtain a higher velocity, single stream.

In one specific application, this invention relates to methods and means for merging two or more separate streams of water to supply a monitor/nozzle system for the purpose of casting a stream of water upon a target.

BACKGROUND ART

It is well known to direct a stream of water upon a target for many purposes including, for example, cooling, cleaning, and fire extinguishing. In fire extinguishing, water is typically supplied to a nozzle from a main or other source through a hose or other conduit interconnecting the two. A single hose is ordinarily adequate to supply relatively small flows of water, less than about 2000 l/min, to either handlines or to mechanically restrained nozzles. Those mechanically restrained nozzles are commonly referred to as monitors, and ordinarily are arranged with swivel joints allowing both vertical and horizontal nozzle travel.

Very great water flows are required to successfully fight large petroleum and chemical fires; particularly fires in large, liquid petroleum storage tanks. Present standards suggest the need for monitors with a capacity in the range of 7,500 to 25,000 l/min to fight such fires. It ranges from impracticable to impossible to supply that level of flow to a portable monitor through a single hose. Consequently, high capacity monitors employ a manifold arrangement allowing for the connection of two, three, or even more, water lines to a single monitor. The manifold arrangement typically comprises a two-way or three-way, Siamese-type fitting with clapper valves to prevent backflow.

The range, or throw distance, of a monitor is of considerable importance in fighting fires. That is particularly true in those instances in which a foam concentrate is added to the water stream thrown by the monitor. When using conventional monitors and aspirating nozzles, it is usual to experience a substantial decrease in throw distance using foam as compared to plain water. Yet, the need for maximizing the throw distance is ordinarily most critical when applying foam.

The range of any monitor/nozzle system, throwing either water or foam, is determined primarily by how efficiently the system converts pressure energy to water velocity (kinetic energy), and by how effectively the nozzle shapes the issuing water (or water-foam) stream so that it does not break apart in the air. A lot of attention has been paid to nozzle design, but little concern has been shown for minimizing turbulence losses while combining different water streams. In fact, the magnitude of such losses appears to be totally unappreciated in the art.

It is evident that improvements in the means used to merge liquid streams, so as to reduce frictional and turbulence losses, will directly translate to increased velocity of the exiting stream. That, in turn, results in an increased throw distance for monitor/nozzle systems and an increased capacity as well. Such improvements in performance are clearly of substantial importance in the art.

DISCLOSURE OF THE INVENTION

This invention provides a method and means for maximizing the conversion of pressure energy to stream velocity during the merger of two or more liquid streams to form a single, combined stream. The stream merging means comprises a central waterway having a plurality of liquid entries and a single liquid exit. Each liquid entry comprises a passageway disposed generally perpendicularly to the longitudinal axis of the waterway, and the entries are arranged in an equi-spaced relationship about that axis. The cross-section of each entry passageway, exterior to but adjacent the waterway, is configured as an ellipse having a major axis and a minor axis, the major axis offset from the longitudinal waterway axis by a small angle. Cross-sectional area of each elliptical entry passageway increases as it approaches the waterway interior. The central waterway is configured generally as an ovoid, truncated at both ends, with the entry passageways positioned adjacent that waterway end opposite the liquid exit. As a liquid enters the waterway through an entry, the increasing cross-sectional area of the passageway creates a zone of reduced pressure within the center of the stream. At the same time, the angular offset between the major axis of the ellipse and the longitudinal axis of the waterway produces a tornado-like, swirling motion to the liquid within the waterway. As the cross-sectional area of the ovoidal waterway decreases near the exit conduit, the rotational energy imparts an ever-increasing velocity to the exiting liquid stream. That exiting stream may then be passed through a swiveled nozzle and directed upon a target.

Accordingly, it is an object of this invention to provide a method and means for efficiently merging two or more liquid streams.

It is another object of this invention to maximize the conversion of pressure energy to stream velocity when merging multiple liquid streams.

A further object of this invention is to provide a method and means for directly merging two or more liquid streams flowing at different rates and pressures.

Yet another object of this invention is to improve the performance of monitor/nozzle systems.

Other objects of the invention will become apparent to one skilled in the art from the following description of various embodiments of the invention.

MODES FOR CARRYING OUT THE INVENTION

Figure 1:
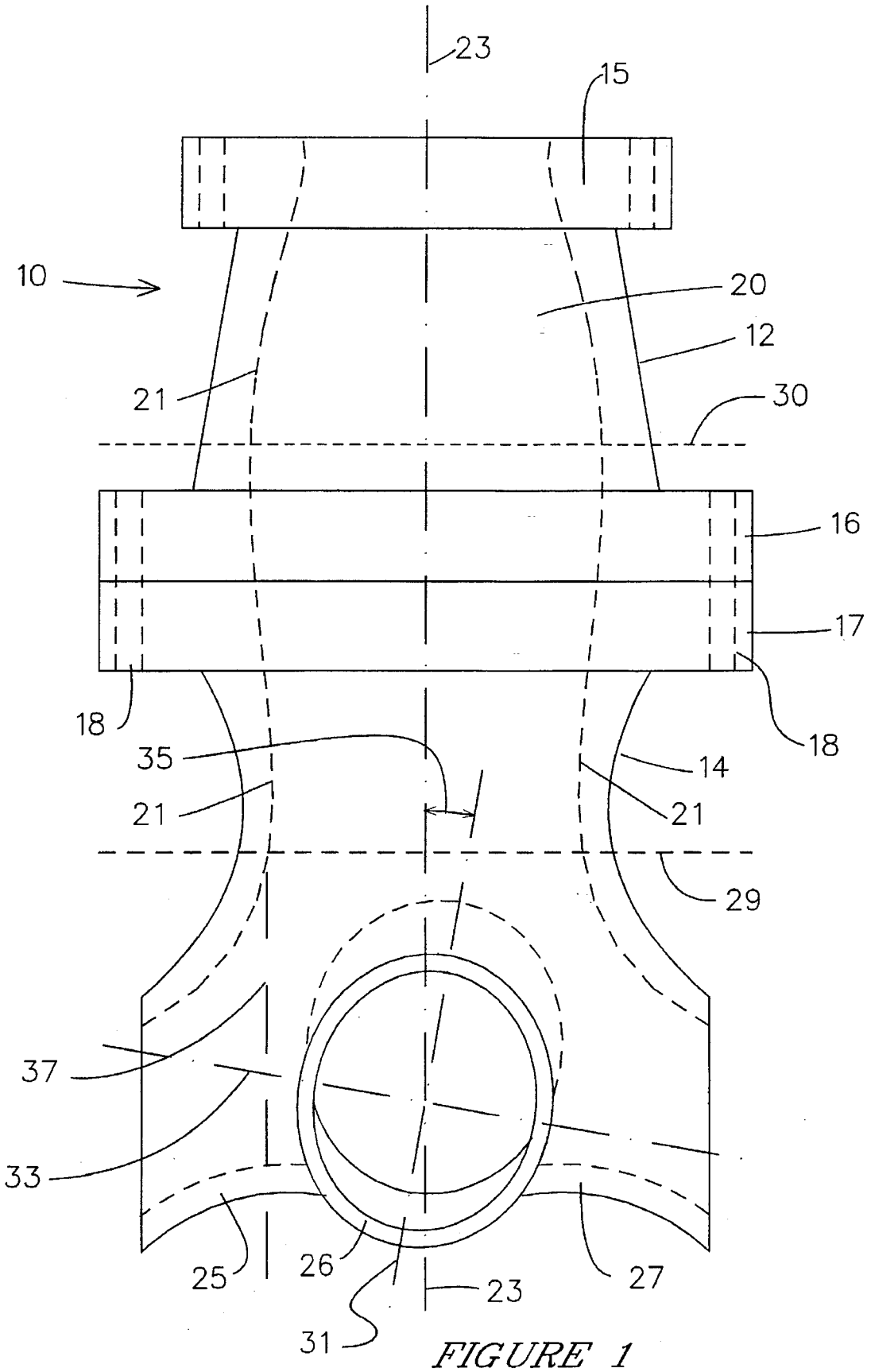
FIG. 1 is a side view of the stream merging means of this invention.

Much of the pressure energy of water or any other liquid flowing through a confined channel is dissipated through friction. Friction losses fall into two general categories; that resulting from the interaction of the liquid with a solid, confining surface, and that generated within the water itself through turbulence in the flowing stream. In a high velocity water stream, such as that flowing in a fire hose, the internal friction dominates, accounting to as much as 90% or more of the total pressure loss. On the other hand, friction between the flowing water and the interior hose wall account for as little as 5% to 10% of the total pressure loss. In like fashion, it has been found that huge frictional losses occur through turbulence when two or more liquid streams are merged in conventional manifolding systems. The fluid stream combining means of this invention serve to dramatically reduce frictional losses, thus allowing a greater amount of pressure energy to be converted into liquid velocity.

That result is obtained by arranging a plurality of liquid entry passageways to intersect an elongated, central waterway of generally ovoid shape, at an angle to the longitudinal axis of the waterway. The entry passageways must be equi-spaced about the longitudinal axis of the waterway and those passageways preferably intersect the waterway at substantially right angles to that axis at a location adjacent a waterway end. Each entry passageway is shaped as an ellipse as it nears its junction with the waterway. The major axis of that ellipse is oriented generally parallel to the longitudinal waterway axis, but offset therefrom by a small angle, less than 30°, and preferably in the range of 1° to 10°. The offset angle must be in the same direction relative to the waterway longitudinal axis for all entry passageways, and the magnitude of all offset angles must be substantially the same. Also, the cross-sectional area of each elliptical entry passageway progressively increases as it approaches the bounds of the waterway.

The effect produced on a liquid by the combination of the elliptical passageway shape, the offset of its major axis from the longitudinal waterway axis, and the increasing cross-sectional area of the passageway is to induce a swirling, upwelling configuration to the liquid within the waterway, much like a small tornado or water spout. That upwelling liquid is directed out of the waterway end opposite the entry passageways at a greatly increased velocity and reduced pressure as compared to the entering streams. A zone of reduced pressure is also created within the core of each entering stream and along the longitudinal waterway axis. The zones of reduced pressure act to draft liquid from the passageways into the waterway, to balance and equalize the entry pressures at the different passageways, and to allow easy introduction of supplemental fluid streams into the waterway through ports in the waterway end opposite its exit. Those supplemental fluid streams may include, for example, a foam concentrate and a liquified, inert gas such as liquid nitrogen or liquid carbon dioxide.

Turning now to FIG. 1, an elevational view of the stream merging means of this invention is shown generally at 10. In this embodiment, means 10 includes an upper housing 12 and a lower housing 14. A free end of upper housing 12 is provided with a flange 15 for connection to a conduit, or to a monitor/nozzle assembly that may be the kind illustrated in FIG. 2. The other end of housing 12 is also provided with a flange 16 that mates with flange 17 of lower housing 14. Flanges 16 and 17 are secured one to the other by means of bolts (not shown) passing through holes 18. It is to be noted that upper housing 12 and lower housing 14 may be formed as a single unit. However, for ease in construction, the dual housing arrangement shown is preferred.

A waterway 20, shown in dashed outline 21, extends from the top to the bottom of the housing members. For the purposes of this disclosure, the free end of housing 12 is taken to be the top of stream merging means 10 as that would be its normal position were a monitor and nozzle to be mounted thereon. However, the functioning of the device does not depend upon its orientation. Waterway 20 is symmetrical about longitudinal axis 23, and is of a generally ovoid shape truncated as a plane at the top of flange 15. A plurality of entry passageways 25, 26, and 27, intersect lower housing 14 adjacent its bottom and are in open communication with waterway 20. The cross-sectional area of waterway 20 progressively increases from a point just above the juncture of the entry passageways, shown as plane 29, and reaches a maximum at an upper waterway level, shown as plane 30. Thereafter, the waterway cross-sectional area again decreases, to match the inside diameter of an exit conduit at the top of flange 15. The ratio of maximum cross-sectional area to exit cross-sectional area directly affects the performance of the device. In general, it has been found that the maximum to exit cross-sectional area should fall within the general range of about 1.25/1 to about 5/1 with a preferred range being between 1.5/1 and 3/1.

Another waterway dimension is of importance as well. The ratio of waterway height, measured from the bottom of the entry passageways to the top of flange 15 where the diameter becomes constant, to the maximum waterway diameter (at plane 30) also affects the performance of the stream merging means. That ratio needs to be greater than 1; that is, the waterway height must be at least as great as its largest diameter. Design experimentation to date indicates that the best performance occurs when the ratio of waterway height to maximum waterway diameter falls between 1.5/1 and 5/1. Further, it appears advantageous for the plane of greatest waterway diameter to fall in the upper half of the waterway, and more particularly, at a point about one-third of the distance between the top of flange 15 and the waterway bottom.

As was stated previously, the entry passageways must be arranged in an equi-spaced manner about the longitudinal axis of the waterway and generally perpendicular thereto. The embodiment of this invention illustrated in FIG. 1 employs four entry passageways arranged at right angles one to another and at generally right angles to the longitudinal axis of the waterway. Side passageways 25 and 27 are spaced at 180° one to the other. Likewise, a second pair of entry passageways, front passageway 26 and a matching rear passageway (not shown in this view) are spaced at 180° one to the other, and at right angles to conduits 25 and 27. While four entry passageways are shown, as few as two entry passageways or as many as can be geometrically accommodated, can be employed so long as the passageways are spaced equi-distant from each other around the waterway axis. In a practical sense, the maximum number of entry passageways is limited to about six or eight. The embodiment shown, using four entry passageways, is presently preferred because it gives some additional flexibility during use.

It is advantageous to use a separate pump or other supply for each entry passageway in order to obtain the very high flow rates desired in the combined stream. In the embodiment shown, the device functions equally well if liquid is supplied either to two, or to all four, of the entry passageways. However, if liquid is supplied to only two of the four entries, it must be supplied to entry passageways opposite, not adjacent, one another. Large losses in efficiency occur if liquid is supplied in a non-symmetrical fashion to the stream merging means of this invention. Thus, were the device to be provided with two, three, or five entries, liquid must be supplied to all of the entries in order for the device to properly function. When using a separate pump to supply liquid to each entry, it is not necessary to match or to balance the pressures or flow rates of the different pumps. Neither is it necessary to match hose lengths between the pumps and the stream merging means. No check valves are required in the entry conduits as the differences in entry pressure of the various incoming streams are automatically compensated for within the stream merging means.

The cross-section of each entry passageway, as defined by the intersection of a plane at right angles to the longitudinal axis of the conduit, must be substantially elliptical as it joins the waterway 20 of stream shaping means 10. As shown with entry conduit 26 the ellipse so formed has a major axis 31 and a minor axis 33 at right angles one to the other. The major axis 31 of the ellipse is oriented generally parallel to the longitudinal axis 23 of waterway 20, but is offset therefrom by a small angle 35. As has been set out previously, angle 35 is preferably in the range of 1° to 10°. For the purposes of this disclosure, the eccentricity of the ellipse will be defined as the ratio of the length of the major axis 31 as compared to the length of the minor axis 33. That ratio must generally fall within the range of about 1.05/1 to 2/1, and more preferably falls in the range of about 1.1/1 to 1.4/1.

The conduits supplying liquid to the entry passageways are most conveniently of cylindrical shape, as in an ordinary length of pipe. The transition from the circular pipe cross-section to the elliptical passageway cross-section must not be abrupt else considerable turbulence losses will occur. Most usually, the length of the transition zone, from circle to ellipse, may be on the order of about one conduit diameter. The cross-sectional area of the entry passageways also increases over a distance of at least a third, and preferably at least a half, of the length of the ellipse major axis, reaching a maximum at the waterway boundary, shown for passageway 25 as plane 37. The ratio of the cross-sectional area of the elliptical passageway, at the waterway boundary, to its smallest cross-sectional area may range between about 1.1/1 and 3/1.

It is further preferred that the radius of curvature of the passageway top be less than that of the passageway bottom over that passageway length whereat the cross-sectional area is increasing. The expanding cross-sectional area of the passageways creates a zone of reduced pressure within the center of an entering liquid stream, and the difference in the radius of curvature of the top and bottom of the passageways directs the top stream portion into the waterway at a steeper angle than is imparted to the lower stream portion. Both of these effects contribute to an efficient merger as liquid streams from opposing passageways tend to intermesh, rather like a zipper, instead of directly interacting. Another practical advantage is obtained through creation of low pressure zones within the waterway. Those low pressure zones act to equalize the pressure head faced by each of the separate incoming streams. Thus, no backflow from one entry passageway to another occurs even though the entering pressures may be considerably different. No check valves are necessary to obtain that result, nor are any used in the means of this invention.

Figure 2:
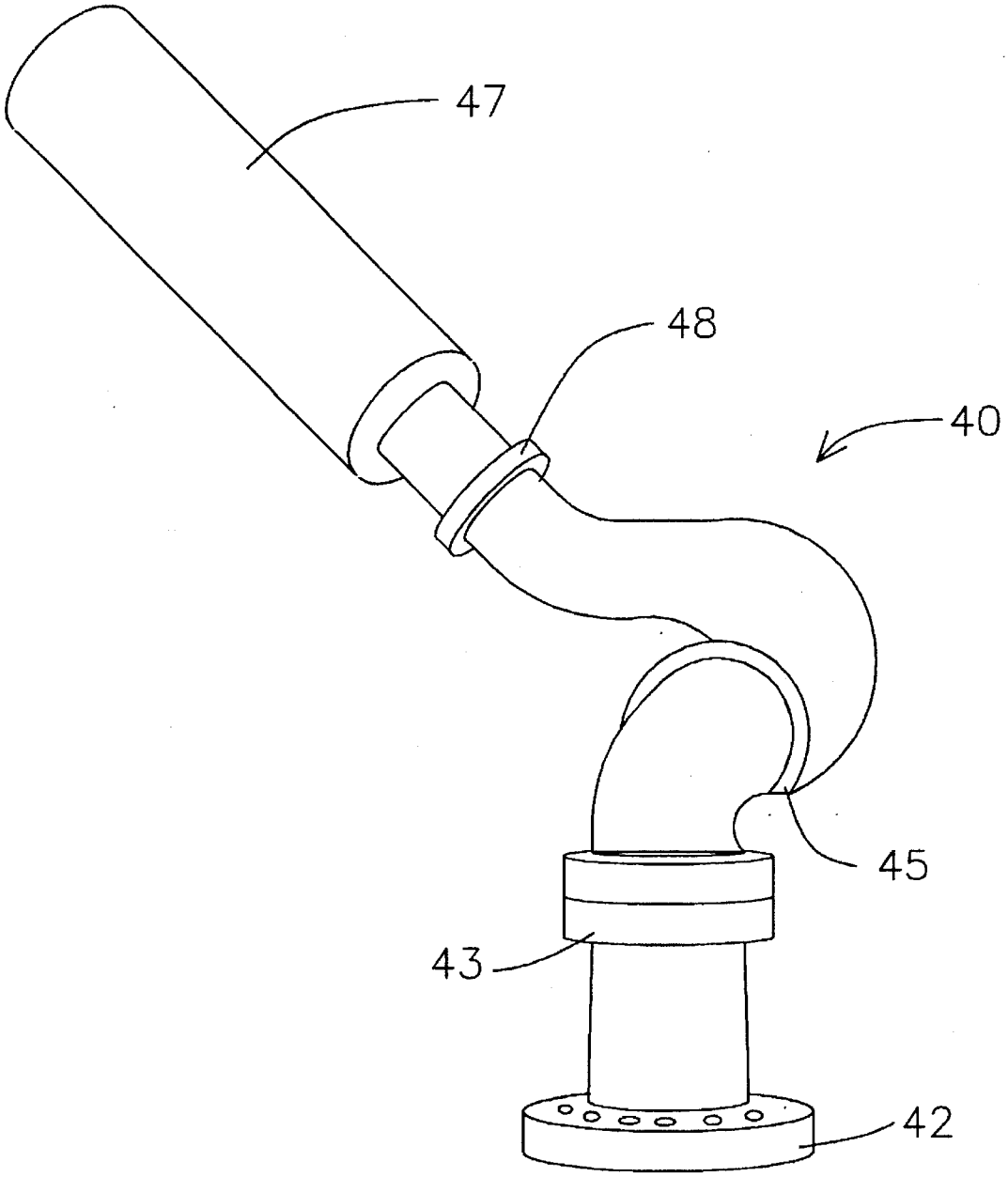
FIG. 2 illustrates a typical monitor and nozzle useful with the means of FIG. 1.

In an embodiment sized for firefighting use, the liquid supply conduits are typically either 4 inches (102 mm) or 5 inches (127 mm) in diameter and the exit conduit at flange 15 is typically 4 inches in diameter. For firefighting purposes, a monitor 40, such as that shown in FIG. 2, is connected to stream merging means 10 by bolting monitor flange 42 to flange 15 of means 10. Monitor 40 preferably includes a swivel arranged to pivot horizontally about rotatable flange means 43 and to swing in a vertical axis about rotatable flange means 45. Nozzle 47 is attached to the swivel end through connector fitting 48. A unit such as described above, supplied by two five inch lines, and delivering water to means 10 at about 150 psi (1034 kPa), will throw in excess of 20,000 l of water per minute a distance of over 500 ft (150 m).

Figure 3:
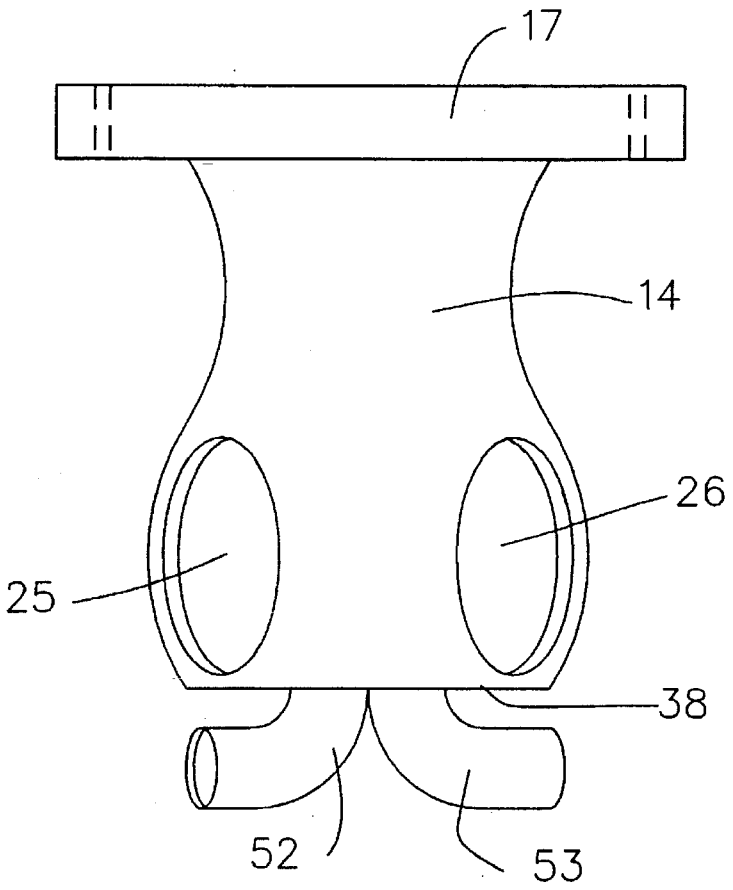
FIG. 3 depicts the means of FIG. 1 adapted for the introduction of additional fluid streams.
Figure 4:
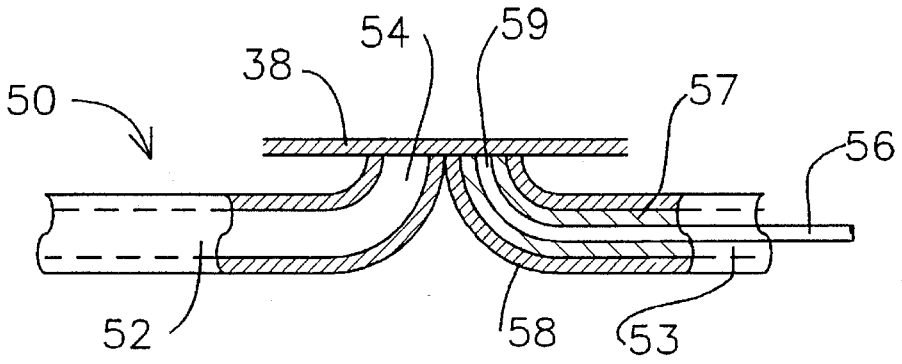
FIG. 4 is a detail in partial cross-section of the fluid stream introduction means of FIG. 3.

Referring now to FIGS. 3 and 4 in combination, there is shown another embodiment of the stream merging means of FIG. 1 employing means to introduce supplemental fluid streams into waterway 20. FIG. 3 depicts the general arrangement of fluid feed means 50 (shown in a more detailed partial section view in FIG. 4) in relation to the lower housing member 14 and entry passageways 25 and 26. The bottom of housing 14 is arranged as a generally flat plate 38 nestled between the entry passageways. In this embodiment, provision is made for the introduction of two supplemental fluid streams; one through entry conduit 52 and the other through entry conduit 53. As is better seen in the view of the entry conduits provided by FIG. 4, the conduits are arranged to handle different kinds of fluids. Entry conduit 52 comprises a tube or pipe that is in communication with waterway 20 through open tube end 54. The other end of conduit 52 is connected to a fluid source (not shown) that is arranged to supply any suitable foam concentrate or other liquid or solid material for transport through the conduit and into the waterway. The fluid source also includes flow control means, valves and the like, to allow an operator to supply a regulated flow of the foam concentrate or other additive for merger with the liquid within the waterway.

A second entry conduit 53 is arranged for a more specialized use. It is arranged for supplying a liquified, inert gas, suitably liquid nitrogen, liquid carbon dioxide, and mixtures of the two, from an external source to the waterway. Conduit 53 includes an inner tube 56, an outer tube 58, and a layer of insulation 57 therebetween. An open end 59 of inner tube 56 is in communication with waterway 20, while the other end is connected to a source of liquified, inert gas (not shown). That inert gas source, if liquid nitrogen, conveniently may comprise an insulated vessel adapted to store liquid nitrogen at moderate pressures, typically in the range of 10 to 100 psig. If liquid carbon dioxide is selected as the liquified, inert gas, then the gas source may be either an insulated vessel, such as is used for liquid nitrogen, or it may be a pressure vessel capable of withstanding the pressure exerted by liquid carbon dioxide at ambient temperatures. Upon its entry into the waterway, the liquified gas will begin vaporizing and expanding as it warms to ambient temperature. That expansion imparts additional velocity to the liquid exiting the stream merging means.

Supplemental fluid streams can, of course, be added simultaneously to the waterway 20 through both entry conduits 52 and 53. Simultaneous addition of a foam concentrate, through conduit 52, and an inert, liquified gas, through conduit 53, provides substantial advantages in firefighting uses of this invention. There is obtained the production of a high quality foam, filled with an inert gas rather than air, that is thrown far further than is possible using conventional equipment. Additionally, a considerable amount of gas dissolves in the water as the liquified gas vaporizes. That dissolved gas considerably enhances the fire extinguishing capabilities of the water stream.

Figure 5:
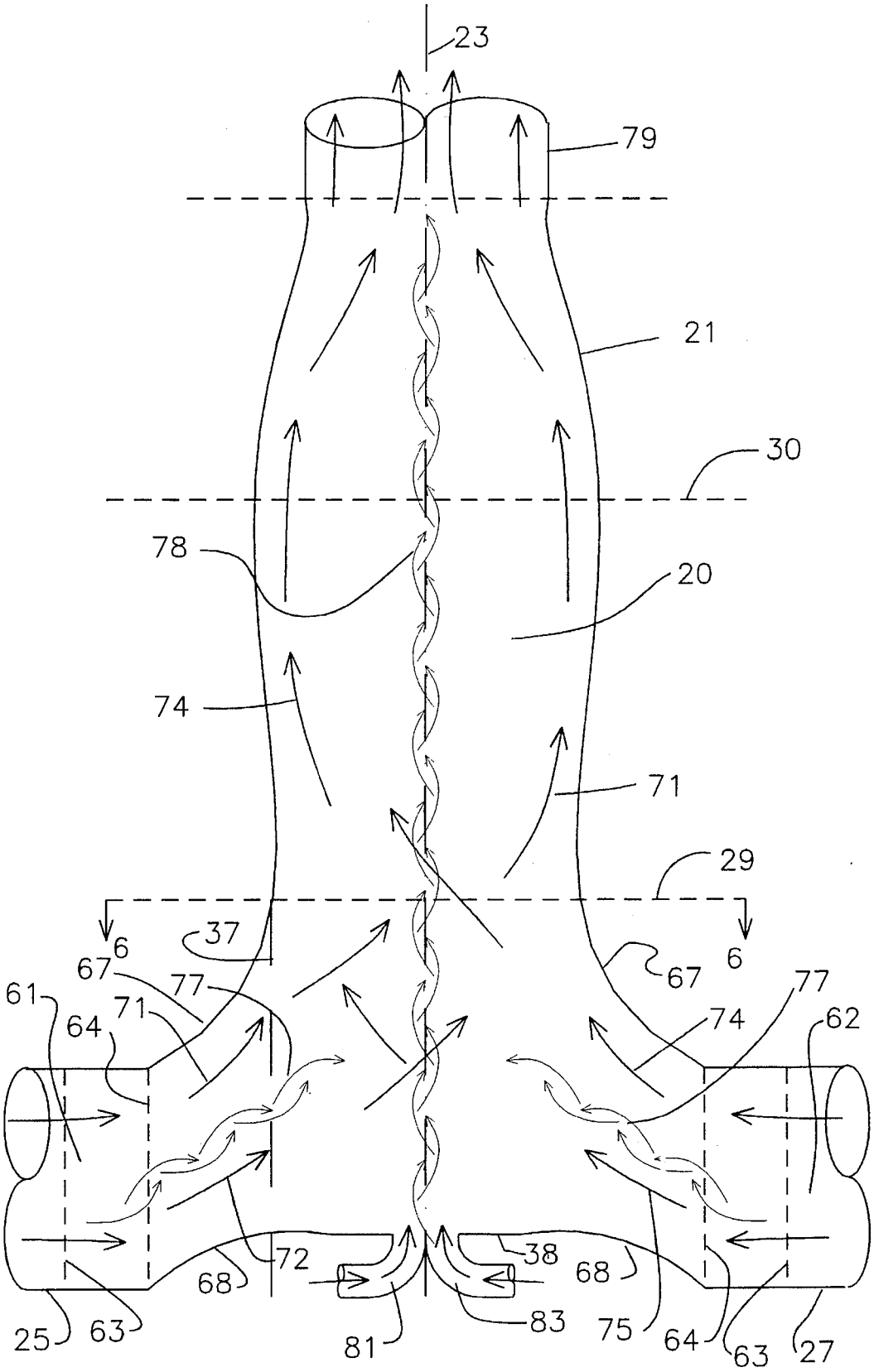
FIG. 5 is a schematic depiction of fluid paths within the waterway of the stream merging means.
Figure 6:
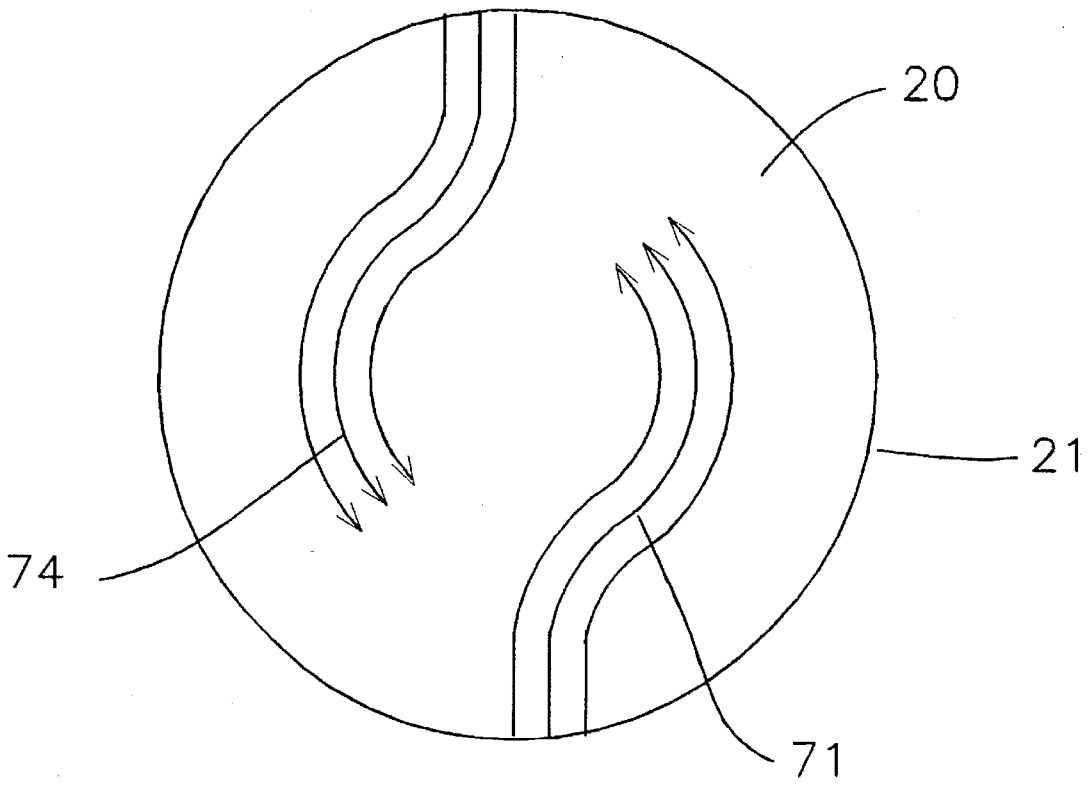
FIG. 6 is a sectional view taken along the lines 6—6 of FIG. 5.

FIG. 5 outlines in cross-section the boundaries of waterway 20, with its connecting conduits and, with FIG. 6, illustrates in a general way the flow patterns occurring within the waterway. FIG. 6 is a sectional view taken along the plane of smallest waterway dimension, line 6—6 of FIG. 5, and plane 29 of FIG. 1. As in FIG. 1, the boundaries of waterway 20 are defined by lines 21. A liquid stream 61, water in this case, enters waterway 20 from the bottom left by way of entry passageway 25, and a similar water stream 62 enters the waterway from the bottom right by way of entry passageway 27. The cross-section of stream 61 upstream of plane 63 is typically circular, but must become elliptical in shape by the time it reaches plane 64. Thereafter, the cross-sectional area of stream 61 increases, reaching a maximum at its juncture with the body of the waterway, shown as plane 37. A sharper degree of curvature 67 is provided to the top of water streams 61 and 62, as compared to the curvature 68 at the bottom of those streams. That difference in curvature, coupled with the increasing cross-section of the entering streams, tends to project the top portion 71 of entering stream 61 at a higher angle than the bottom portion 72 of that same stream is projected. Likewise, the top portion 74 of entering stream 62 is projected at a higher angle that is the bottom portion 75 of that stream.

Referring now to FIG. 6 as well as to FIG. 5, and tracking only the upper stream portions 71 and 74, the streams deflect obliquely against the wall 21 of waterway 20 causing an upward, rotating movement to the body of water contained in the waterway. As was set out in the discussion of FIG. 1, the liquid streams entering the waterway are shaped as an ellipse, with the major axis of the ellipse being oriented at a small angle to the waterway longitudinal axis 23. That arrangement causes streams 71 and 74 to intermesh much like the teeth of a zipper, rather than colliding, in spite of the fact that the two streams enter directly opposite one from the other. The streams do, however, interact at their borders, and that interaction tends to impart a rotational moment to each stream.

The tendency for the top and the bottom of the entering streams to separate causes areas of lower pressure 77 to develop within the central portions of the entering streams. That lower pressure acts to draft water from the entry passageways and into the waterway. Those areas, or zones, of low pressure merge to form a vertically extending low pressure area 78 along the longitudinal axis 23 of the waterway. Low pressure area 78 extends to a point at, or near, the bottom 38 of lower housing 14 and dissipates as the water stream leaves the waterway to enter a constant diameter zone 79. The effect thus obtained can be visualized as somewhat like a tornado, with the apex extending into the constant diameter zone 79. The low pressure produced within the waterway 20 adjacent its bottom allows other fluid streams 81 and 83 to be inducted into the waterway. As was set out in the discussion of FIGS. 3 and 4, fluid stream 81 may comprise a foam concentrate, while fluid stream 83 is a liquified, inert gas.

The means of this invention has been described primarily in relationship to its use in merging multiple water streams for use in firefighting. It is also possible to reverse the flow through the system and use it to split one large, high velocity stream into a number of smaller, lower velocity streams. A myriad of other uses for the disclosed systems will be apparent to those skilled in the art without departing from the spirit and scope of the invention.

I claim:

1. A device for merging a plurality of liquid streams comprising:

a housing confining an internal waterway with two ends, said waterway having an elongated, generally ovoid shape and being symmetrical about a longitudinal axis, one of said waterway ends exiting into a conduit of regular cross-section; and a plurality of entry passageways joining said waterway adjacent the other of said waterway ends, said passageways equi-spaced about the waterway longitudinal axis, each said passageway having a cross-section shaped as an ellipse at its junction with said waterway, said ellipse having a major axis and a minor axis, the major ellipse axis oriented generally parallel to said waterway longitudinal axis, but offset therefrom by a small angle, the major ellipse axis of each said passageway being parallel, one to another.

2. The device of claim 1 wherein the end of said waterway exiting into said conduit of regular cross-section is separated from the other of said waterway ends by a distance that is greater than the diameter of said waterway, and wherein said small angle is less than 30°.

3. The device of claim 2 wherein the cross-sectional area of said waterway progressively increases downstream from the juncture of said entry passageways with said waterway, said area reaching a maximum at a point intermediate the waterway ends, the cross-sectional area of said waterway thereafter progressively decreasing downstream of said maximum point, said area reaching a minimum at said exiting waterway end, and wherein said maximum area divided by said minimum area yields a value between 1.25 and 5.

4. The device of claim 2 wherein the ratio of the length of said major ellipse axis to the length of the ellipse minor axis is between 1.05/1 and 2/1.

5. The device of claim 2 wherein the ratio of the cross-sectional area of said elliptical passageway at its juncture with the waterway to its smallest cross-sectional area is in the range of 1.1/1 and 3/1.

6. The device of claim 2 wherein each said entry passageway is cylindrical in cross-section upstream of its junction with said waterway, and wherein a transition from circular cross-section to elliptical cross-section occurs in a zone adjacent to and just upstream from the point of said junction, the cross-sectional area of said passageway progressively increasing from the upstream end of said zone to the downstream end of the zone.

7. The device of claim 2 having four entry passageways, said passageways arranged at right angles one to another, and at generally right angles to the longitudinal axis of said waterway.

8. The device of claim 3 wherein said small angle is between 1° and 10°; wherein the distance between the waterway ends is between 1.5 and 5 times the waterway diameter at said point of maximum waterway cross-sectional area; wherein said point of maximum waterway cross-sectional area is closer to the exit end of said waterway than to the other waterway end; and wherein said maximum waterway cross-sectional area divided by said minimum waterway cross-sectional area yields a value between 1.5 and 3.

9. The device of claim 2 including means to introduce supplemental fluid streams into said waterway, said means comprising at least one entry conduit communicating with the waterway at said other waterway end.

10. The device of claim 9 wherein said means comprises two separate entry conduits, one of said conduits arranged to convey a liquified, inert gas into said waterway.

11. A method for merging a plurality of relatively high pressure, liquid entry streams to form a single lower pressure, but higher velocity, liquid exit stream comprising:

passing said entry streams into an elongated waterway at a location adjacent one waterway end, said waterway being of generally ovoid shape, and having a longitudinal axis;

arranging said streams in an equi-spaced relationship about said longitudinal axis shaping each said entry stream to form, in cross-section, an ellipse of continuously expanding area as said stream passes into the waterway, said ellipse having a major axis and a minor axis;

orienting each said entry stream such that its major ellipse axis is generally parallel to said waterway longitudinal axis, but offset therefrom by a small angle; and causing said entry streams to merge and rotate within said waterway to create a zone of reduced pressure within the waterway, and to exit from an other end of the waterway as a unified exit stream of lower pressure, but of higher velocity, than said entry streams.

12. The method of claim 11 wherein at least one of said entry streams is at a different pressure, and flowing at a different rate, than the other entry streams.

13. The method of claim 12 wherein said zone of reduced pressure within the waterway acts to equalize the pressures of the streams entering the waterway.

14. The method of claim 11 wherein said small offset angle is between 1° and 10°.

15. The method of claim 11 wherein a supplemental fluid stream is introduced into the waterway at a location adjacent the entry point of said high pressure liquid entry streams.

16. The device of claim 1 having a monitor and nozzle mounted thereon, and communicating with said waterway; said monitor arranged to pivot horizontally about rotatable flange means, and to pivot vertically, whereby the nozzle can be brought to bear upon a target.

17. The device of claim 16 including means to introduce supplemental fluid streams into the waterway of said steam merging device, said introduction means comprising at least one entry conduit communicating with the waterway through the waterway bottom.

18. The device of claim 17 wherein said introduction means includes two separate entry conduits, one of said conduits arranged to convey a foam concentrate into said waterway, and the other of said conduits arranged to convey a liquified, inert gas into the waterway.

* * * * *